United States Patent [19]

Ramelet

[11] Patent Number: 4,973,267

[45] Date of Patent: Nov. 27, 1990

[54] ID COMPOSITE CONNECTOR FOR SWITCH, AND METHOD

[75] Inventor: Bernard Ramelet, Herblay, France

[73] Assignee: AMP Incorporated, Harrisburg, Pa.

[21] Appl. No.: 327,477

[22] Filed: Mar. 22, 1989

[30] Foreign Application Priority Data

May 10, 1988 [FR] France ..... 88 06289

[51] Int. Cl.[5] ..... H01R 13/42

[52] U.S. Cl. ..... 439/590; 29/866; 439/596; 439/710; 439/717

[58] Field of Search ..... 439/590, 596, 710, 717, 439/404; 29/857, 861, 865, 866

[56] References Cited

U.S. PATENT DOCUMENTS

| | | | |
|---|---|---|---|
| 3,909,935 | 10/1975 | Aldridge et al. | 29/628 |
| 4,354,719 | 10/1982 | Weidler | 439/398 X |
| 4,425,018 | 1/1984 | Stenz | 439/717 X |
| 4,428,114 | 1/1984 | Teagno | 29/857 |
| 4,629,279 | 12/1986 | Nishikawa | 339/210 M |

FOREIGN PATENT DOCUMENTS

| | | |
|---|---|---|
| 0104874 | 4/1984 | European Pat. Off. . |
| 2458919 | 1/1981 | France . |
| 2481007 | 10/1981 | France . |

*Primary Examiner*—Steven C. Bishop

*Attorney, Agent, or Firm*—Thomas G. Terrell; William B. Noll

[57] ABSTRACT

Electrical connectors each having one row of electrical terminals, are joined together in end to end relationship by slugs formed integrally with end walls of the connectors. Lead receiving portions of the terminals of both of the connectors are loaded with electrical leads, which extend therefrom in the same direction. The slugs are then removed so as to separate the connectors. Dovetail cross section ribs on a side wall of one connector are then slid into complementary grooves in a side wall of the other connector so as to couple the connectors together in back to back relationship, with the leads projecting from opposite sides of the composite two row connector so provided. The invention enables the leads to be loaded into the connectors by means of a lead loading apparatus which is capable of loading electrical connectors only from one side thereof.

6 Claims, 7 Drawing Sheets

ID COMPOSITE CONNECTOR FOR SWITCH, AND METHOD

BACKGROUND OF THE INVENTION

This invention relates to a composite electrical connector and to a method of loading it with electrical leads.

There is described in U.S. Pat. No. 4,428,114, an electrical connector comprising an elongate insulating housing defining a row of cavities each opening into a lead receiving face of the housing and each receiving an electrical terminal having a lead receiving portion arranged to be loaded with an electrical lead inserted into the cavity by way of the lead receiving face.

There is also described in the patent specification mentioned above a harness making apparatus for loading such connectors with leads. In this known apparatus, and in others for the mass production of electrical harnesses, the connectors are advanced lengthwise through a lead insertion station, to which for reasons of mechanical convenience in the construction of the apparatus, the leads are all presented from one side of insertion station. Such apparatus are therefore only capable of loading electrical connectors having a single row of terminals, the leads that have been loaded into the lead receiving portions of the terminals all projecting from the same side of the connectors.

There is, nevertheless, now a demand, for example, for mating with certain kinds of automotive switches, for two row electrical connectors, that is to say connectors having two juxtaposed rows of electrical terminals, and which have been loaded with leads, the leads which have been loaded into the wire receiving portions of the terminals of one row projecting in the opposite direction to those that have been loaded into the wire receiving portions of the terminals of the other row.

SUMMARY OF THE INVENTION

According to one aspect of the invention, an electrical connector as defined in the second paragraph of the present specification, is characterised in that it is composite, in that the housing is joined at one end, to one end of the housing of a similar electrical connector, with the lead receiving faces of the connectors in substantially coplanar relationship, by means of readily severable member, the housing of each connector being provided with means for coupling it to the housing of the other connector in back to back relationship, when said member has been severed, so that the rows of cavities of the two connectors lie in parallel relationship and open in the same direction.

Thus prior to severing said member, the composite connector can be loaded with leads by apparatus of the kind described in outline above, in which the leads are presented to the lead insertion station from the same direction, after which, the severable member is severed, for example at a severing station of the apparatus itself. The severed connections can then be coupled together, as aforesaid, to provide what is in effect a two row connector from which the leads that have loaded into the lead receiving portions of the terminals of one row project in the opposite direction to the leads that have been loaded into the lead receiving portions of the terminals of the other row.

The two connectors, which although similar to one another, need not be identical with one another, can in any event be produced in a single moulding operation.

The two connectors are necessarily supplied to, and emerge from, the harness making apparatus in matching pairs so that connector handling is facilitated.

According to another aspect of the invention, a method of loading an elongate electrical connector with electrical leads, in which method the leads are inserted in a direction transversery of their length into lead receiving portions of electrical terminals of the connector through openings in a lead receiving face thereof, said lead receiving portions being arranged in a row; is characterised in that the connector is joined at one end to one end of a similar electrical connector with the lead receiving faces of the connectors in substantially coplanar relationship; and by the steps of loading an electrical lead into the lead receiving portion of each terminal of both of the connectors so that the leads project from the same side of each connector, then severing the connectors from each other and coupling the connectors together in parallel, back to back, relationship so that the leads of one connector project in the opposite direction to those of the other connector.

The two connectors may conveniently be coupled together by means of slidably inter-engaging ribs and grooves, for example of dovetail cross-sectional shape, positive retention means being provided for retaining the two connectors firmly in their coupled position.

The connectors may be provided with means which resiliently inter-engage in the coupled condition thereof, so as to urge the ribs into firm engagement with the walls of the grooves.

For a better understanding of the invention and to show how it may be carried into effect, reference will now be made, by way of example, to the accompanying drawings.

DETAILED DESCRIPTION OF THE PREFERRED EMBODIMENT

Figure 1:
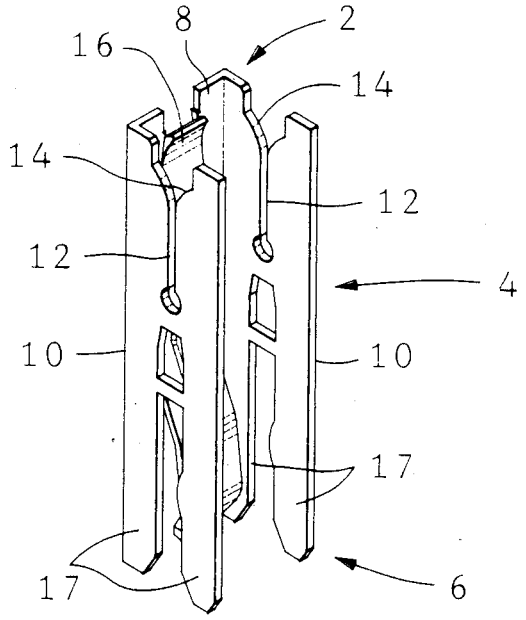
FIG. 1 is an isometric view of an electrical terminal.
Figure 2:
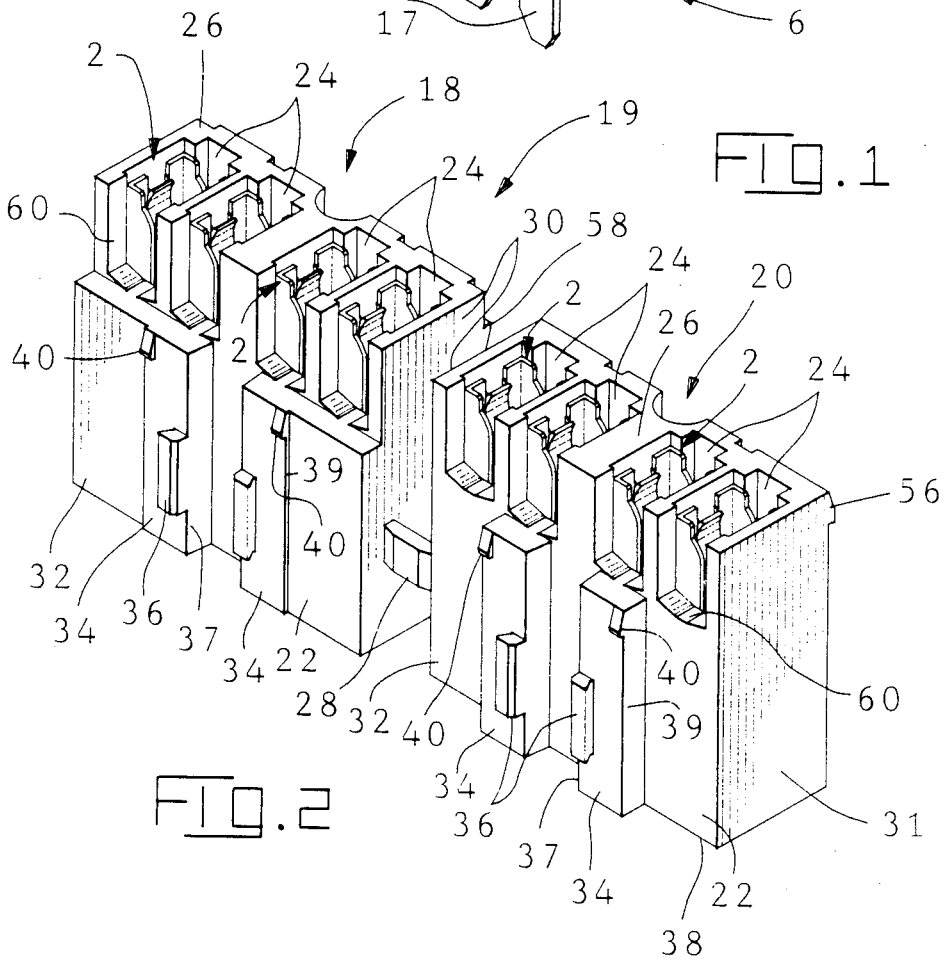
FIG. 2 is an isometric view of a composite electrical connector, comprising two electrical connectors joined together by severable slugs, and being provided with terminals according to FIG. 1.

As shown in FIG. 1, an electrical terminal 2 comprises a lead receiving portion 4 and a receptacle portion 6. The terminal 2 which is of a channel shape, has a base 8 from opposite edges of which project parallel side walls 10, normally of the base 8. The portion 4 comprises opposed wire slots 12 formed in the side walls 10 and each having a lead receiving mouth 14, a lead hold down tongue 16 projecting from the base 8 inwardly of the terminal 2 at the level of the mouths 14. The receptacle portion 6 comprises two pairs of resilient arms 17 cut out from the side walls 10, for mating with a flat electrical tab.

As shown in FIGS. 2, 5, 8 and 9, a composite electrical connector 19 comprises two elongate electrical connectors 18 and 20, respectively, which are similar but are not identical. Each connector 18 and 20 comprises an elongate insulating housing 22 defining a row of cavities 24 each opening into a lead receiving face 26 of the housing 22 and each receiving an electrical terminal 2. The connectors 18 and 20 are joined together in end to end relationship by readily severable members in the form of slugs 28 formed integrally with opposed, adjacent, end walls 30 of the housings 22. Each slug 28 is of reduced cross section proximate to each end wall 30, tapering there towards from an enlarged longitudinally central part. Each housing 22 has an end wall 31 opposite to its end wall 30. As will be apparent at least from FIGS. 2 and 9, the lead receiving faces 26 of the housings 22 of the connectors 18 and 20 are coplanar. One side wall 32 of each housing 22 is formed with a pair of parallel elongate bosses 34 which are spaced from one another longitudinally of the housing 22 and extend normally of its face 26, from a mating face 38 of the housing 22, opposite to the face 26 thereof. On each boss 34 is a hooked cross section bead 36 near the mating face 38 and adjacent to a longitudinal edge 37 of the boss 34. The hooks of the beads 36 are directed away from one another and there is provided on each rib 34, at its end the nearest to the face 26 and adjacent to an opposite edge 37 of the panel 34, a latching projection 40. Each housing 22 has a side wall 42 opposite to its side wall 32.

The side wall 42 of the housing 22 of the connector 18 is formed in the vicinity of the face 38, near each end wall 30 and 31 of the housing, with a dovetail cross section groove 44, which extends normally of the face 38, for sliding engagement with a corresponding dovetail cross section rib 46 formed on the side wall 42 of the housing 22 of the connector 20 and which extends from the face 38 of the connector 20 towards the face 26 thereof by the same distance that the grooves 44 extend from the face 38 of the connector 18, that is to say for about a third of the distance between the faces 26 and 38. Each side wall 42 of each connector 18 and 20 is provided, substantially centrally thereof, with an arcuate recess 48. On either side of each recess 48 is an undercut groove 50 which opens into the face 38 and which defines in cooperation with a rectangular cross section, groove 52 parallel and adjacent thereto, in the wall 42, a resilient stop 54 extending along the wall 42 towards the face 26. A hook detent member 56 is provided adjacent to each wall 30 and 31 and to the face 26, of the connector 20, the members 56 being directed away from that face, for engagement with respective oppositely directed hooked detent members 58 on the wall 42 of the housing 22 of the connector 18, the members 58 being spaced from the face 26 of the connector 18 towards its face 38.

Figure 6:
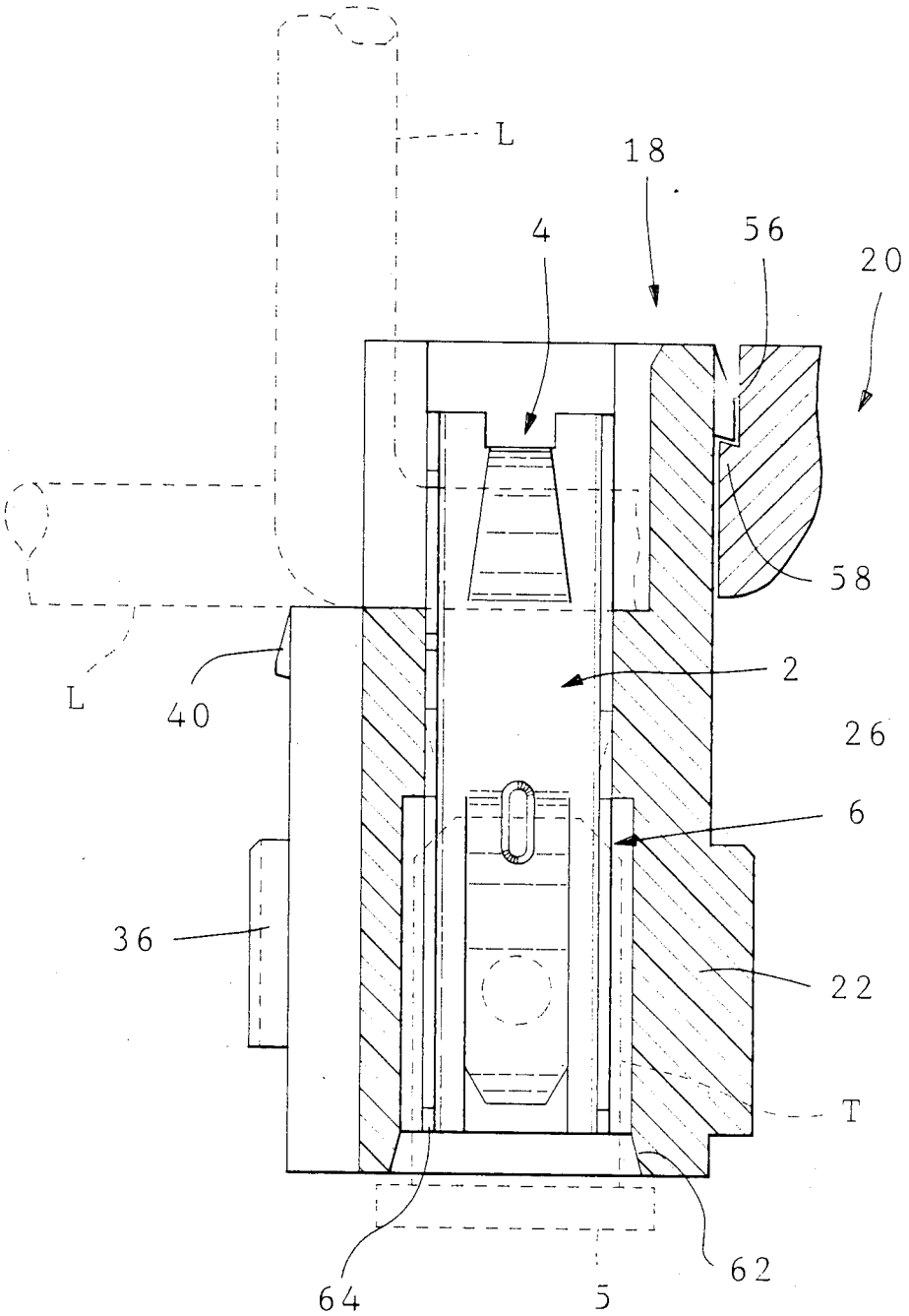
FIG. 6 is a cross sectional view showing one of the connectors of the composite connector when mated with an electrical tab on an automotive switch, the tab, the leads and part of the switch being shown in broken lines.

The side wall 32 of each housing 22, has a cut out 60 opening into the face 26 in alignment with the lead receiving portion 4 of each terminal 2 and communicating with the corresponding cavity 24. The face 38 has rectangular, tab receiving, openings 62 and 62$^1$ each communicating with a respective cavity 24, the two central openings 62$^1$ being substantially longer than the two outer openings 62 and extending into the bosses 34. As best seen in FIG. 6, each terminal 2 is located in its cavity 24 with its receptacle portion 6 in alignment with a respective opening 62 or 62$^1$ and with the mouths 14 of the wire slots 12 of the terminal 2 beneath, but directed outwardly of, the face 26, the edge of the base 16 of the terminal 2 resting upon a ledge 64 bounding the respective opening 62 or 62$^1$.

In order to provide what is in effect a two row electrical connector with leads inserted into the wire receiving portions 4 of the terminals of one row projecting from one side of the connector and leads inserted into the wire receiving portions 4 of the terminals of the other row projecting from the opposite side of the connector, the following steps are carried out.

Figure 3:
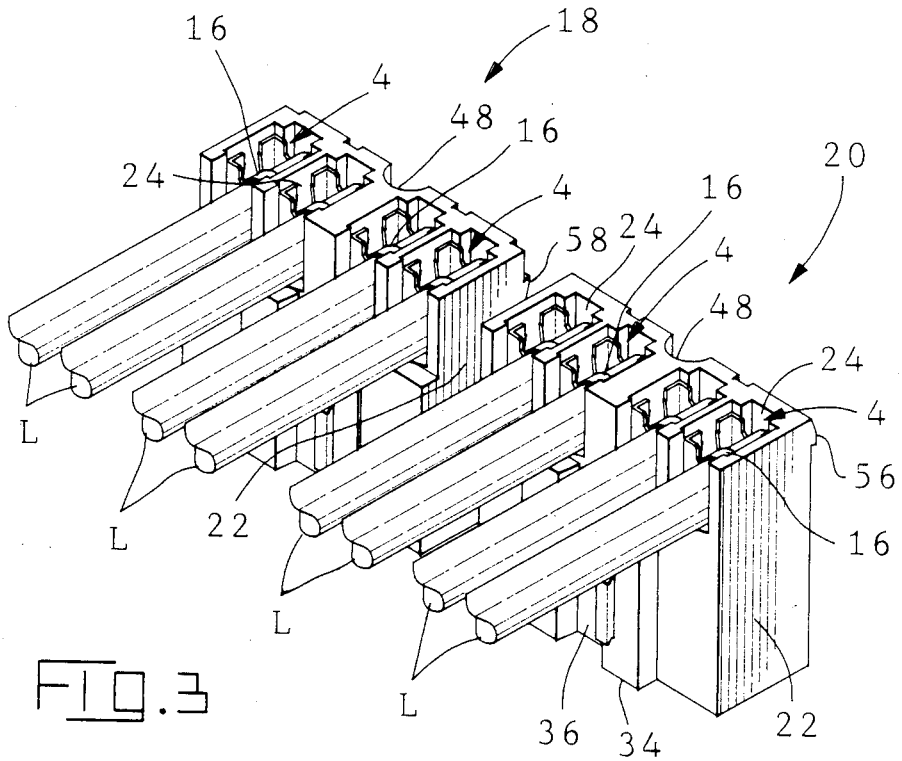
FIG. 3 is a similar view to that of FIG. 2, showing the composite connector loaded with electrical leads.
Figure 4:
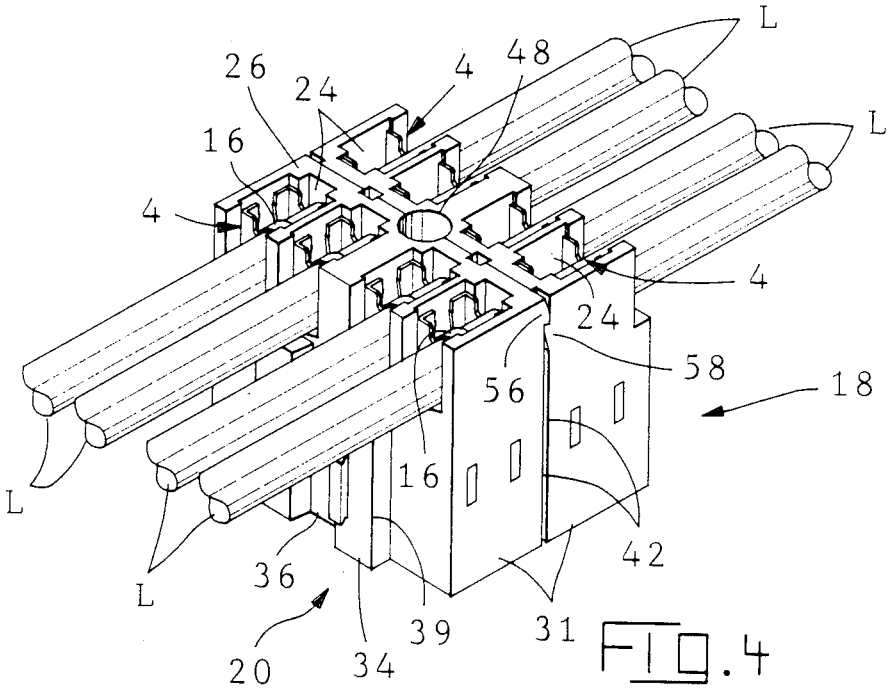
FIG. 4 is an isometric view showing the connectors of FIG. 3 in coupled relationship, the slugs having previously been severed.
Figure 5:
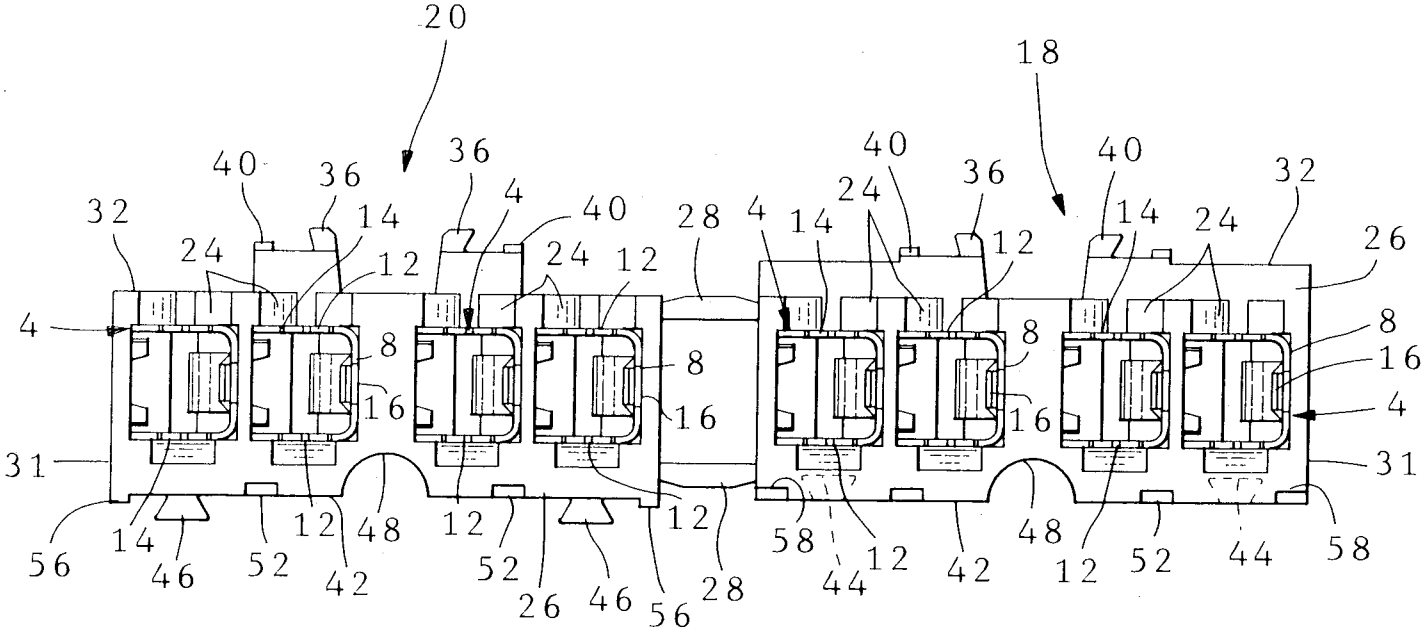
FIG. 5 is a top plan view of FIG. 2.
Figure 7:
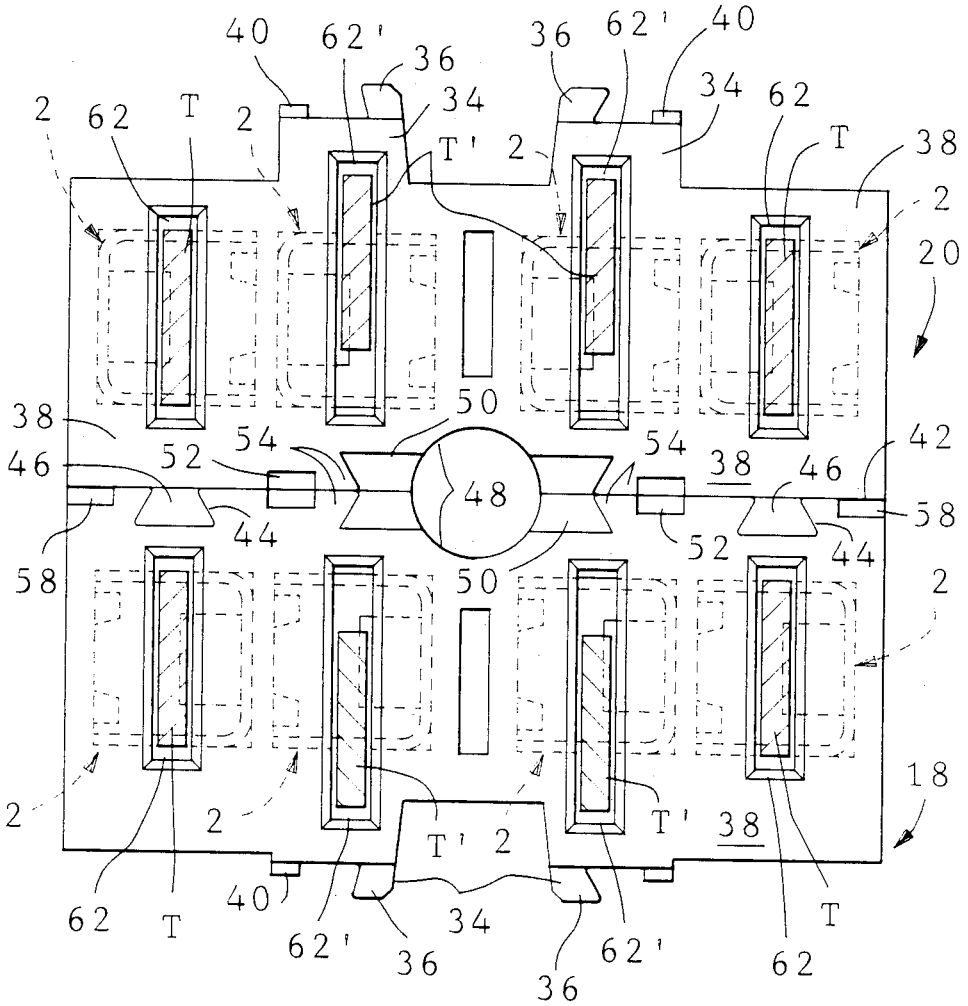
FIG. 7 is an underplan view of FIG. 4 showing the composite connector when mated with the tabs of the switch.
Figure 8:
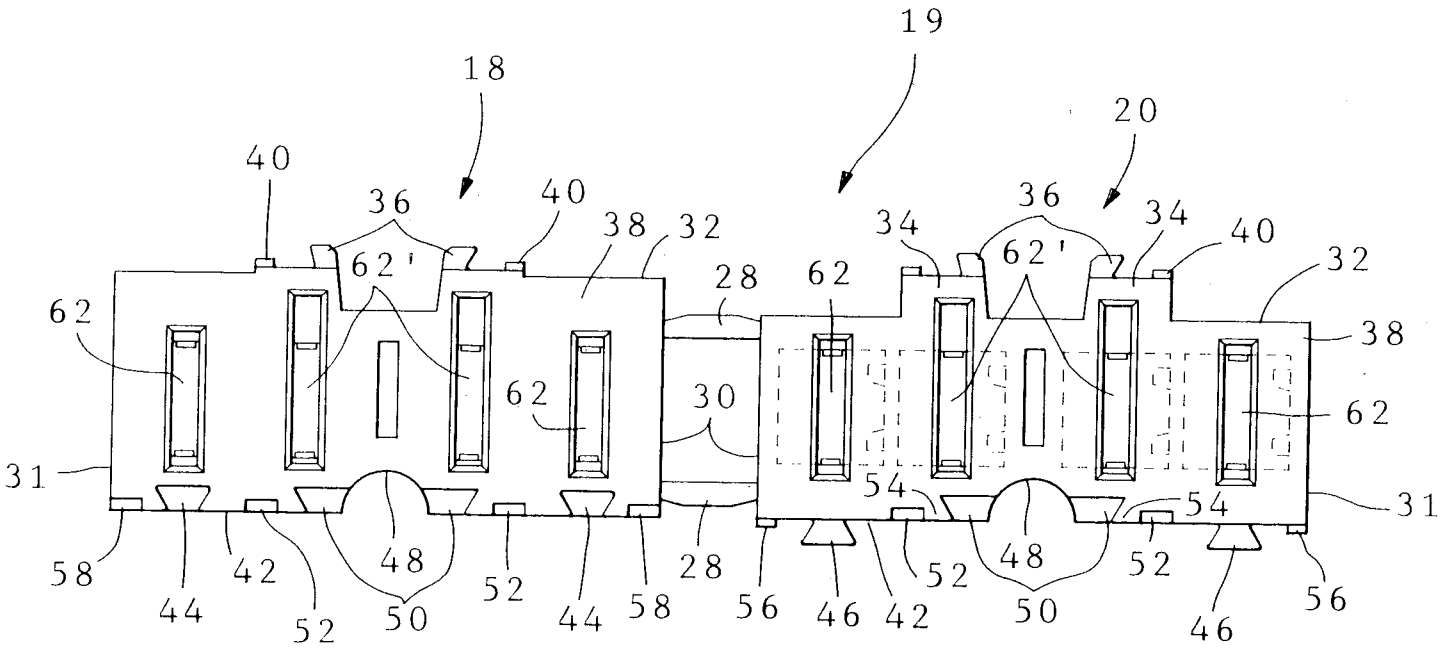
FIG. 8 is an underplan view of FIG. 2.
Figure 9:
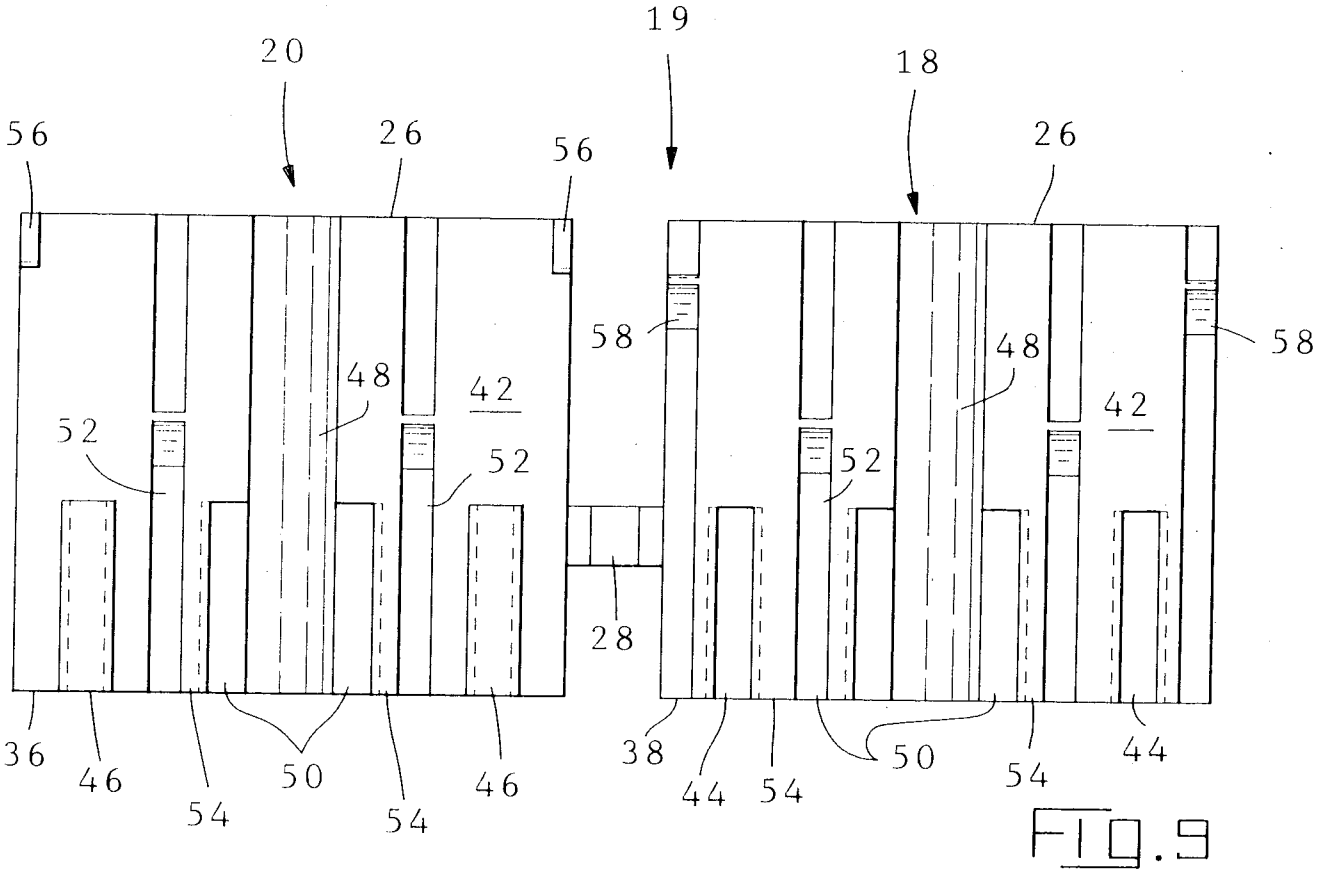
FIG. 9 is a side view of FIG. 2 taken from the side thereof remote from the reader.

The composite connector 19 is supplied to a harness making apparatus, for example as described in U.S. Pat. No. 4,428,114 mentioned above, by means of which an insulated electrical lead L is inserted into each of the wire receiving portions 4 of the terminals 2 of the composite connector 19 (in FIG. 3). Each lead L is forced by lead insertion tooling of the apparatus into the wire slots 12 of the respective portion 4, so that the edges of the slots 12, pierce the insulation of the lead L and make permanent electrical contact with the metal core thereof. The lead hold down tongues 16 are curled over by the insertion tooling to hold the leads down in the slots 12. The slugs 30 are then removed by slugging-out tooling of the apparatus, so that the connectors 18 and 20 are separated from each other. The separated and lead loaded connectors 18 and 20 are then removed from the apparatus and the ribs 46 of the connector 20 are slidably inserted into the grooves 44 of the connector 18 to couple the connectors 18 and 20 together, in back to back relationship as shown in FIG. 4. As the ribs 46 are pushed home into the grooves 44, the hooked members 56 of the connector 20 engage over the hooked members 58 of the connector 18 so that the connectors 18 and 20 are positively locked in their coupled position, as best seen in FIG. 4. As best seen in FIG. 7, the resilient stops 54 of one connector 18 and 20 engage those of the other thereby urging the inclined sides of the ribs 46 against the walls of the grooves 44. In the coupled position of the connectors 18 and 20, the recesses 48 cooperate to define a central circular, through opening for receiving a fastener, for example a bolt.

The two row connector effectively so provided, can be mated with a switch S from which project two rows of flat electrical tabs T and T$^1$ (FIGS. 6 and 7). The tabs T$^1$ which are centrally disposed in each row are offset from the remaining tabs T. Such offset tabs T$^1$ can be accommodated, because the central openings 62$^1$ of each connector 18 and 20, are longer than the remaining openings 62 as described above. Although each outer tab T is received between the arms 18 of both pairs, of the respective receptacle portion 6, the central tabs T$^1$ are received between the arms 18 of only one pair thereof.

The ribs 36 and projections 40 serve to cooperate with complementary members in the housing (not shown) of the switch S to lock the connectors 18 and 20 therein. The composite two row connector can also be used for example, as a connector for automobile headlamps, or signal lights.

An advantage of providing the connectors 18 and 20 in joined pairs, is that the connectors of each pair, which as will be apparent from the above description, differ slightly from one another, can be produced in a single mould. Also, the connectors 18 and 20 are necessarily supplied to, and emerge from, the harness making apparatus in matching pairs. Some, or all of, the leads may be bent up (as illustrated in broken lines in FIG. 6) in situ, for connecting the switch S to appropriate terminals in the vehicle.

I claim:

1. An electrical connector comprising an elongate insulating housing defining a row of cavities each opening into a lead receiving face of the housing and each receiving an electrical terminal having a lead receiving portion arranged to be loaded with an electrical lead inserted into the cavity by way of the lead receiving face, wherein the connector is a composite in that the housing is joined at one end to one of the housing of a similar electrical connector with the lead receiving faces of the connectors in substantially coplanar relationship, by means of a readily severable member, the housing of each connector being provided with means for coupling it to the housing of the other connector in back to back relationship, when said member has been severed, so that said rows of cavities of the two connectors lie in parallel relationship and open in the same direction, said coupling means comprising a rib on a side wall of one connector adjacent to the lead receiving face thereof and extending normally of that face and a groove in the corresponding side wall of the other connector, extending normally of the lead receiving face thereof, wherein both the rib and the groove are of dovetail cross section and that said rib is slidably receivable in said groove, and that means are provided on the housing of each connector for resiliently urging the connectors apart from one another when they have been coupled together, to urge the rib against the walls of the groove.

2. An electrical connector according to claim 1, wherein the housings of the connectors are provided with opposed hook members which are interengageable when the rib has been inserted into the groove positively to lock the housings in a coupled position.

3. An electrical connector according to claim 2, wherein each terminal comprises a receptacle portion aligned with an opening in a mating face of the housing of the connector, for receiving a male electrical contact member, each opening being elongate and extending transversely of the length of the housing and of the mating face, whereby at least one of the openings is of greater length than the remaining openings.

4. An electrical connector according to claim 2, wherein the readily severable member comprises at least one slug formed integrally with opposed end walls of the connectors, whereby each said slug is of reduced cross sectional area in the vicinity of said opposed end walls.

5. A method of loading an elongate electrical connector with electrical leads, in which the leads are inserted in a direction transversely of their length, into lead receiving portions of electrical terminals of the connector through openings in a lead receiving face thereof, the said lead receiving portions being arranged in a row, the method comprising the steps of joining said connector at one end to one end of a similar electrical connector with the lead receiving faces of the connectors in substantially coplanar relationship, loading an electrical lead into the lead receiving portion of each terminal of both of the connectors so that the leads project from the same side of each connector, then severing the connectors from each other and coupling the connectors together in parallel back to back relationship, so that the leads of one connector project in the opposite direction to those of the other connector.

6. A method according to claim 5, wherein the connectors are coupled together by relatively moving them in a direction at right angles to their length, slidably to engage ribs of one connector in grooves in the other connector and to engage positive locking members on the two connectors when the ribs have been fully engaged in the grooves, positively to lock the connectors in their coupled condition.

* * * * *

UNITED STATES PATENT OFFICE

CERTIFICATE OF CORRECTION

Patent No. 4,973,267 Dated November 27, 1990

Inventor(s) Bernard Ramelet

It is certified that error appears in the above-identified patent and that said Letters Patent is hereby corrected as shown below:

In claim 1, column 5, line 17, after the second occurrence of the word "one" add the word --end--.

Signed and Sealed this

Twenty-fifth Day of August, 1992

*Attest:*

DOUGLAS B. COMER

*Attesting Officer*

*Acting Commissioner of Patents and Trademarks*